United States Patent [19]

Kagohara et al.

[11] Patent Number: 4,465,530

[45] Date of Patent: Aug. 14, 1984

[54] GAS TURBINE NOZZLE HAVING SUPERIOR THERMAL FATIGUE RESISTANCE

[75] Inventors: Hiromi Kagohara; Nobuyuki Iizuka; Yutaka Fukui; Masahiko Sakamoto, all of Hitachi, Japan

[73] Assignee: Hitachi, Ltd., Tokyo, Japan

[21] Appl. No.: 415,999

[22] Filed: Sep. 8, 1982

[30] Foreign Application Priority Data

Sep. 11, 1981 [JP] Japan ..... 56-142225

[51] Int. Cl.[3] ..... C22C 19/05

[52] U.S. Cl. ..... 148/410; 148/158; 148/162; 148/419

[58] Field of Search ..... 148/410, 419, 427, 428, 148/442, 158, 162; 420/443, 445–451, 454, 588

[56] References Cited

U.S. PATENT DOCUMENTS 4,283,234 8/1981 Fukui et al. ..... 148/410

*Primary Examiner*—R. Dean

*Attorney, Agent, or Firm*—Antonelli, Terry & Wands

[57] ABSTRACT

Disclosed in a gas turbine nozzle having a superior thermal fatigue resistance. The gas turbine nozzle is made of a cast alloy consisting essentially of 0.1 to 1 wt % carbon, 0.1 to 2 wt % silicon, 0.1 to 2 wt % manganese, 20 to 35 wt % chromium, 0.001 to 0.1 wt % boron, 5 to 15 wt % of at least one of tungsten and molybdenum, 16 to 35 wt % cobalt and the balance nickel. The alloy has a heat-treated structure in which eutectic carbides and secondary carbides are dispersed in the matrix.

14 Claims, 8 Drawing Figures

No. 5 x100

No. 2 x100

GAS TURBINE NOZZLE HAVING SUPERIOR THERMAL FATIGUE RESISTANCE

BACKGROUND OF THE INVENTION

The present invention relates to a novel gas turbine nozzle. Generally, a gas turbine nozzle has a construction as exemplarily shown in FIG. 1 and is produced by a precision casting. A typical example of materials of this gas turbine nozzle is a Co-base heat-resistant superalloy or Ni-base heat-resistant superalloy. The term "heat-resistant superalloy" will be abridged as "superalloy", hereinafter.

The Co-base superalloy exhibits a superior high temperature corrosion resistance at temperatures below 1000° C., but suffers an inferior high temperature oxidation resistance at temperatures above 1000° C. In addition, this superalloy has an inferior high temperature ductility and tends to become brittle to generate cracks by an application of an external force such as thermal stress. When a diffusion coating of Al is applied, $\delta$ phase of Co-Al compound is formed thereby causing an embrittlement. Furthermore, this superalloy exhibits an inferior weldability.

There are two types of Ni-base superalloy: namely, $\gamma'$ phase strenghtening type superalloy making use of the precipitation of $Ni_3(Al,Ti)$ which constitutes the $\gamma'$ phase, and a carbide strenghtening type superalloy. The Ni-base superalloy of $\gamma'$ phase strengthening type, on one hand, exhibits a superior high temperature oxidation resistance at temperatures above 1000° C. but, on the other hand, suffers an inferior high temperature corrosion resistance at temperatures below 1000° C. due to a small Cr content. In addition, this superalloy contains Ti and Al in excess of solid solution limit and is strengthened by $\gamma'$ phase, so that this superalloy exhibits a large high temperature strength, but the thermal fatigue resistance, which is an important property for the material forming a gas turbine nozzle, is lower than that of the Co-base superalloy. The Ni-base superalloy of $\gamma'$ phase strengthening type, therefore, cannot be used suitably as the material forming a mechanical part which is subjected to repetitional heat cycles. It is to be pointed out also that the melt of this superalloy has to be made by vacuum melting, because of its large Ti and Al contents. This superalloy, therefore, is not suitable for use as the material forming a gas turbine nozzle having a large size.

The Ni-base superalloy of another type, i.e. the carbide strenghtening type, has superior high temperature strength, ductility, creep rupture strength, thermal fatigue resistance (resistance to thermal shock) and high temperature corrosion resistance at temperatures around 982° C. at which the gas turbine nozzles are used. In addition, this superalloy can be produced easily by melting in air atmosphere. On the other hand, however, this superalloy exhibits only small ductility and, moreover, a poor thermal fatigue resistance (resistance to thermal shock) which is an important factor for gas turbine nozzle material, at temperatures around 800° C. to which the blades are heated in general purpose gas turbines that operate at gas temperatures higher than 1000° C. This fact is attributable to the presence of cellar continuous eutectic carbide in the grain boundary. The microstructure of carbide strengthening type Ni-base superalloy contains eutectic carbides crystallized in the grain boundary and secondary carbides precipitated mainly in the grains. A certain amount of eutectic carbides is effective in improving the creep rupture strength through suppressing the grain boundary sliding. It has been proved, however, that the presence of the coarse eutectic carbides in cellar continuous form in the grain boundary promotes the propagation and development of cracking due to the stress concentration to the brittle eutectic carbides by application of thermal fatigue (thermal shock), particularly when the material is subjected to a high temperature and repetitional heat cycles of heating and rapid cooling as in the case of gas turbine nozzles. It has been proved also that such eutectic carbides are thermally stable and are not changed substantially by ordinary heat treatment.

Examples of gas turbine nozzles made of Ni-base superalloy are disclosed in the specification of the U.S. Pat. No. 4,283,234. This Ni-base superalloy, however, has a low cobalt content, so that it is inferior in creep rupture strength and thermal fatigue resistance.

SUMMARY OF THE INVENTION

Accordingly, it is a primary object of the invention to provide a gas turbine nozzle having a superior thermal fatigue resistance.

To this end, according to the invention, there is provided a gas turbine nozzle made of a cast alloy consisting essentially of 0.1 to 1 wt % carbon, 0.1 to 2 wt % silicon, 0.1 to 2 wt % manganese, 20 to 35 wt % chromium, 0.001 to 0.1 wt % boron, 5 to 15 wt % of at least one of tungsten and molybdenum, 16 to 35 wt % cobalt and the balance nickel, said alloy having a heat-treated structure in which eutectic carbides and secondary carbides are dispersed in the matrix.

In order to improve the thermal fatigue resistance through stabilizing the microstructure, the gas turbine nozzle in accordance with the invention is subjected to a solution heat treatment and an aging treatment.

The gas turbine nozzle in accordance with the invention exhibits a superior resistance to thermal fatigue (thermal shock) because the eutectic carbides are discontinuous and fine. Namely, since the eutectic carbides are discontinuous, the crack which has been propagated through the brittle carbides is temporarily stopped by the matrix and the stress is relieved by a deformation, so that the stress concentration is suppressed. In consequence, ductility and, hence, the thermal fatigue resistance are improved. The improvement in the thermal fatigue resistance is very important in the material for gas turbine nozzles. According to a result of an analysis, the thermal stress generated in the actual gas turbine nozzle is very large and well exceeds the yield strength of heat-resistant alloy. Thus, the cracking in the nozzle due to thermal fatigue (thermal shock) takes place in an early stage. The life or durability of the nozzle, therefore, is largely affected by the speed of propagation of the crack. It is also understood that the thermal fatigue resistance is proportional to the ductility rather than to the high temperature strength. It proved also that the amount and form of the eutectic carbides are largely affected by the amount of C,Co,W and Mo.

Hereinafter, an explanation will be given as to the reasons of limitation of contents in the cast alloy composition used as the material of the gas turbine nozzle in accordance with the invention.

The carbon (C), which is a carbide former, plays a very important role in improving high temperature strength, ductility and resistance to thermal fatigue (thermal shock). When the C content is less than 0.1% it is impossible to obtain a high temperature strength due to insufficient precipitation of the secondary carbides. In addition, the precipitated secondary carbides exhibit acicular form thereby increasing the tendency to form δ phase when the chromium (Cr) content is high, so that the resistance to thermal fatigue is considerably low. To the contrary, any C content exceeding 1% causes an excessive and continuous crystallization of eutectic carbides, resulting in a lower ductility. For these reasons, the C content should be selected to range between 0.1 and 1 wt %, preferably between 0.1 and 0.6 wt % and more preferably between 0.2 and 0.35 wt %.

The chromium (Cr) is the principal element for the formation of secondary carbides and serves to increase the high temperature strength. In addition, the chromium forms an oxide coating film which protects further oxidation to improve the corrosion resistance and oxidation resistance at high temperature. As stated before, resistance to thermal fatigue is the most important factor for the material of gas turbine nozzle. The thermal fatigue resistance, however, is deteriorated if the Cr content is decreased, because of errosion of grain boundary due to high temperature corrosion. For obtaining sufficient resistance to corrosion and thermal fatigue, the Cr content is preferably higher than 20 wt %. To the contrary, any Cr content exceeding 35 wt % undesirably permits continuous crystallization of eutectic carbides, resulting in a reduction of thermal fatigue resistance and creep rupture strength. The Cr content, therefore, should be selected to range between 20 and 35 wt %, preferably between 25 and 28 wt %.

At least one of tungsten (W) and molybdenum (Mo) should be contained by 5 wt % or more for achieving solid solution strenghtening of the matrix. These elements are strong carbide formers and exist in the form of combination of carbon and (Cr, Mo, W) which is a composition obtained by substituting for a part of Cr of Cr carbide. If the content of at least one of tungsten (W) and molybdenum (Mo) is less than 5 wt %, the solid solution strenghtening is extremely small and, hence, the creep rupture strength is small impractially. When the content exceeds 15 wt %, the eutectic carbides in the grain boundary are increased and take continuous form to reduce the resistance to thermal fatigue. The content of at least one of tungsten (W) and molybdenum (Mo), therefore, should be selected to fall within the range between 5 and 15 wt %, preferably 5 and 10 wt % and more preferably 6 and 8 wt %.

The cobalt (Co) is a very important element for achieving higher thermal fatigue resistance, and is usually added for attaining solid solution strengthening. It proved, however, that the Ni-base cast alloy of the invention exhibits a remarkable improvement in the thermal fatigue resistance (resistance to thermal shock), and creep rupture strength when the Co content is increased beyond 16 wt %, because the eutectic carbides are decreased and made discontinuous, as will be understood from FIG. 2. Any Co content exceeding 35 wt %, however, causes a saturation of the effect but, rather, produces a tendency of reduction in the intergranular corrosion resistance. For these reasons, the Co content should be selected to range between 16 and 35 wt %, preferably between 20 and 30 wt %.

Various test materials were prepared and heat-treated in the same manner as the embodiments of the invention which will be described later, from a composition consisting essentially of about 0.25% C., about 1 wt % Si, about 0.5 wt % Mn, about 27 wt % Cr, about 7.5 wt % W, about 0.01 wt % B, about 0.1 wt % Ti, about 0.2 wt % Nb and Co which was varied within the range of between 0 and 50 wt %. These test materials were subjected to a thermal shock test for examining the relationship between the crack length and the Co content, the result of which is illustrated in the diagram shown in FIG. 2.

The titanium (Ti) and niobium (Nb) serve to form MC type carbides to increase the high temperature strength, while suppressing the embrittlement by heating through restraining the growth of the secondary carbides thereby to increase the thermal fatigue resistance and long-term creep rupture strength. The MC type carbides uniformly precipitate at the inside and outside of the grains. As a result, the excessive precipitation to the grain boundary is suppressed thereby improving the ductility. A too large Ti content, however, degrades the casting surface while a too large Nb content lowers the high temperature corrosion resistance undesirably. Each of Ti content and Nb content, therefore, should fall within the range between 0.02 and 1 wt %, preferably between 0.1 and 0.5 wt %. More specifically, the Ti content and Nb content preferably ranges between 0.1 and 0.2 wt % and between 0.2 and 0.3 wt %, respectively. The M/C ratio (M being the sum of contents of MC carbide formers) preferably ranges between 0.1 and 0.15 in atomic ratio.

Since the yttrium (Y) and aluminum (Al) are added aiming at improving the oxidation resistance and high temperature corrosion resistance, they are added in such a small amount within their solubility limits that U the $\gamma'$ phase does not precipitate at all or, if any the precipitation of $\gamma'$ phase is only a trace. It is to be noted that the addition of Al is not intended for the precipitation of $\gamma'$ phase, in contrast to the conventional $\gamma'$ phase strengthening type Ni-base superalloy in which Al is added to promote the precipitation of $\gamma'$ phase. Both of Y and Al contents should be smaller than 0.01 wt % for attaining sufficient effect, and should not exceed 1 wt % for otherwise the weldability will be deteriorated seriously. For these reasons, each of Y content and Al content is selected to range between 0.01 and 1 wt %, preferably between 0.05 and 0.3 wt %.

The boron (B) is added to precipitate in the grain boundary to strengthen the latter, thereby improving the high temperature ductility. A too small B content, however, cannot provide apprecitable effect, while a too large B content deteriorates the weldability. The B content, therefore, is selected to fall within the range between 0.005 and 0.1 wt %, particularly between 0.01 and 0.05 wt %.

The silicon (Si) and manganeses (Mn) added as deoxidizer are contained by more than 0.1 wt %, respectively. However, if the Si content and the Mn content exceed 2 wt %, the creep rupture strength is decreased and, thus, both contents are restricted to less than 2 wt %. Especially preferable range is 0.1 to 1 wt % for Si and 0.2 to 1 wt % for Mn.

The tantalum (Ta), hafnium (Hf) and zirconium (Zr) promote precipitation of fine carbides and serve as nucleus for the eutectic carbides to prevent the carbides from crystalliazing in continuous from thereby increasing the strength and toughness. In order to provide appreciable effect, the Ta, Hf and Zr contents should be greater than 0.05 wt %. On the other hand, when the Ta, Hf and Zr are added in excess of 2 wt % the C content in the matrix is lowered due to formation of the carbides of Ta, Hf and Zr to suppress the precipitation of the secondary Cr carbide resulting in a reduction in the creep rupture strength. The Ta, Hf and Zr contents, therefore, are selected to range between 0.05 and 2 wt %, preferably between 0.1 and 0.5 wt %.

A material for the gas turbine nozzle of the invention can take either one of the following forms (1) to (4): namely, (1) a cast alloy containing at least one of Ti and Nb; (2) cast alloy containing at least one of Ta, Hf and Zr or a cast alloy mentioned in the above item (1) further containing at least one of Ta, Hf and Zr; (3) cast alloy containing B soley or cast alloy of the above item (1) or (2) further containing B; and (4) cast alloy containing at least one of Y and Al or cast alloy of any one of the above items (1), (2) and (3) further containing at least one of Y and Al.

It is preferable that the sum of Ti content and Nb content be between 0.02 and 1 wt %, more preferably 0.1 and 0.5 wt %. Further, it is preferable that the total contents of at least two of Ta, Hf and Zr be between 0.05 and 2 wt %, more preferably 0.1 and 1 wt %. When one of Ti and Nb is added together with one of Ta, Hf and Zr, the aforementioned preferred range for each elements is applied. When both of Ti and Nb are added together with two or more of Ta, Hf and Zr, the above-mentioned preferred ranges for combinations are applied. It is preferable that the sum of Y content and Al content be between 0.01 and 1 wt %, preferably 0.05 and 0.3 wt %.

The gas turbine nozzle of the invention has been subjected to a solution heat treatment at 1100° to 1200° C., a first aging treatment at 950° to 1050° C. and a second aging treatment at 700° to 800° C. The solution heat treatment causes the precipitates to be dissolved thereby making the microstructure homogeneous. The first aging treatment is conducted at a temperature higher than the temperature at which the gas turbine nozzle is used, in order to precipite the secondary carbides. The second aging treatment is conducted at a temperature near the temperature at which the gas turbine nozzle is used, in order to improve the ductility and, thereby, reducing the speed of propagation or development of crack.

DESCRIPTION OF THE PREFERRED EMBODIMENT

The following Table shows chemical compositions of test materials in terms of weight percent (wt %). The material represented by sample No. 1 is a conventional material while materials Nos. 2 to 4 are comparative materials. Materials in accordance with the invention are represented by Nos. 5 to 9. All of the test materials Nos. 1 to 9 were formed by melting the materials in the atmosphere and then conducting precision casting into test pieces of 12 mm dia. and 100 mm long.

TABLE

| | Chemical composition (wt %) | | | | | | | | | | |
|---|---|---|---|---|---|---|---|---|---|---|---|
| No. | C | Si | Mn | Cr | W | Zr | B | Ti | Nb | Co | Ni |
| 1 | 0.25 | 1.0 | 1.0 | 28.0 | 7.0 | — | 0.01 | — | — | Bal. | 10.5 |
| 2 | 0.44 | 0.14 | 0.2 | 26.2 | 8.67 | 0.42 | 0.012 | — | — | — | Bal. |
| 3 | 0.26 | 0.5 | 0.6 | 27.5 | 15.2 | 0.10 | 0.012 | — | 0.2 | 10.5 | Bal. |
| 4 | 0.24 | 0.9 | 0.5 | 27.1 | 15.2 | 0.09 | 0.012 | — | 2.0 | 10.1 | Bal. |
| 5 | 0.25 | 0.9 | 0.5 | 26.5 | 7.5 | — | 0.012 | — | — | 20.8 | Bal. |
| 6 | 0.25 | 0.8 | 0.6 | 26.3 | 7.3 | — | 0.012 | 0.15 | 0.25 | 20.0 | Bal. |
| 7 | 0.25 | 0.8 | 0.6 | 26.7 | 7.6 | 0.2 | 0.012 | 0.15 | 0.25 | 20.0 | Bal. |
| 8 | 0.26 | 0.8 | 0.6 | 26.5 | 7.5 | — | 0.012 | 0.25 | 0.25 | 20.2 | Bal. |
| 9 | 0.38 | 1.06 | 0.56 | 28.9 | 6.8 | — | 0.012 | — | — | 29.9 | Bal. |

Figure 1:
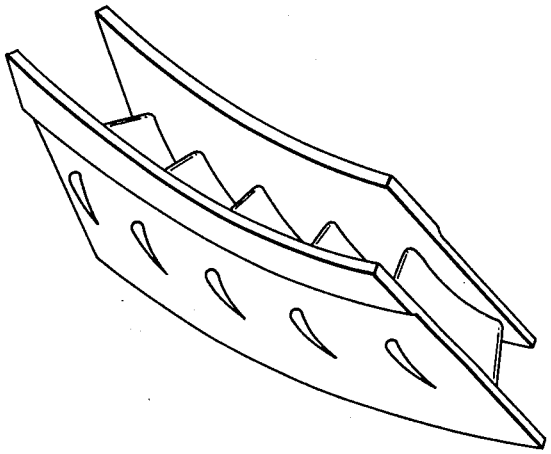
FIG. 1 is a perspective view showing an example of a gas turbine nozzle.
Figure 2:
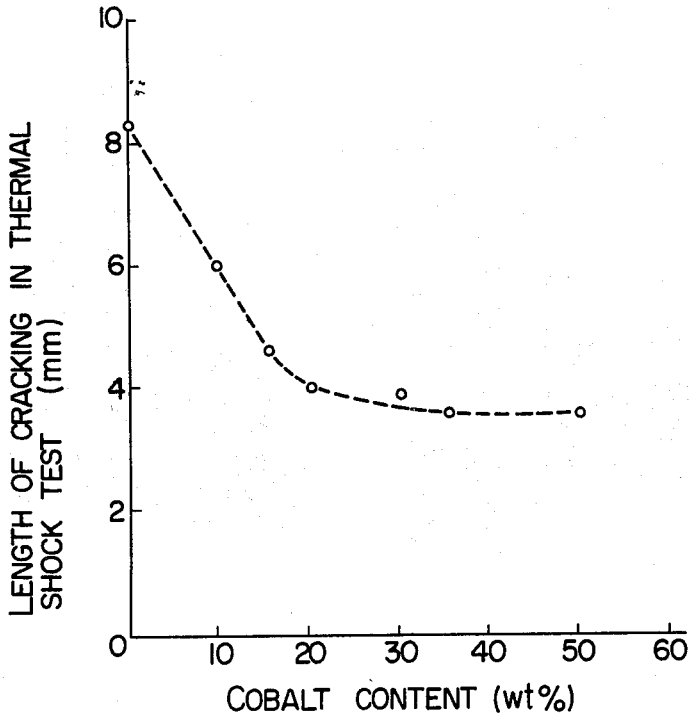
FIG. 2 is a graph showing the relationship between length of cracking and cobalt content in alloys as observed through a thermal shock test.
Figure 3:
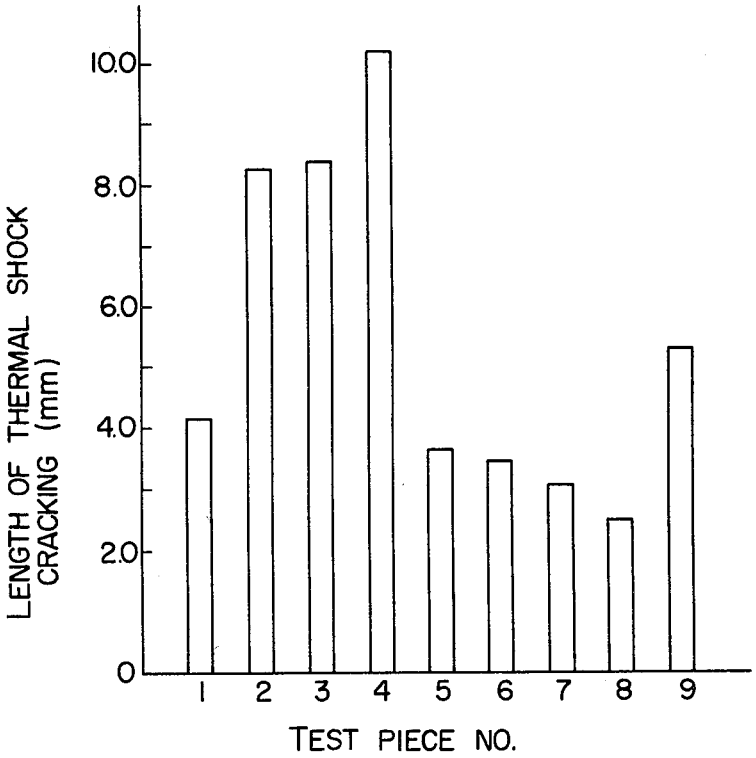
FIG. 3 is a bar graph showing the length of cracking generated by thermal shock in various nozzle materials.

The test material No. 1 has been subjected to a solution heat treatment conducted at 1150° C. for 4 hours and an aging heat treatment conducted at 982° C. for 4 hours. Materials Nos. 2 to 9 have been subjected to a solution heat treatment conducted at 1175° C. for 2 hours and an aging heat treatment conducted at 982° C. for 4 hours. The evaluation of the thermal fatigue resistance was made using test pieces of 10 mm dia. and 10 mm long by a method having the steps of: effecting 300 cycles of heating and rapid cooling, each cycle consisting of heating the test piece up to and holding at 850° C. for 6 minutes and then rapidly cooling the test piece from this temperature by immersing the test piece in water; splitting the test piece in the vertical direction; and measuring the lengths of cracks generated in the section of split. The result of this test is shown in FIG. 3. The test material No. 1, which is a conventional Co-base alloy, exhibits a superior thermal fatigue resistance, as is well known. It will be seen that the materials of the invention represented by sample Nos. 5 to 9 exhibits thermal fatigue resistance substantially equivalent or superior to that of the conventional material of sample No. 1. The test material No. 2, which is an Ni-base alloy containing no Co, is much inferior to the materials of the invention. Materials No. 3 and 4, which contain about 15% of W, cannot provide sufficient thermal fatigue resistance.

Figure 4A:
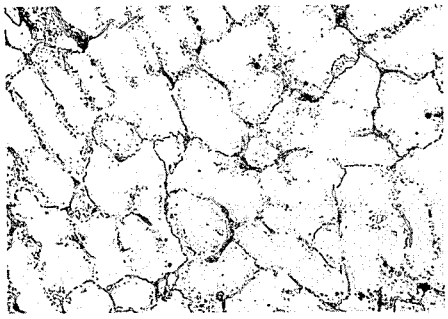
FIG. 4*a* is a microscopic photograph (magnification 100) showing the microstructure of an alloy used as the material of gas turbine nozzle in accordance with the invention.
Figure 4B:
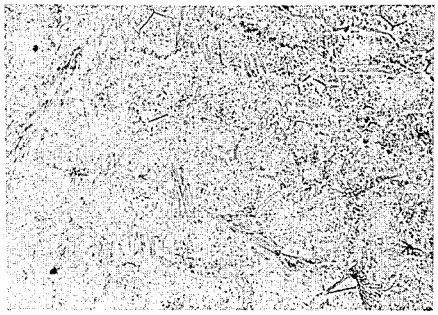
FIG. 4*b* is a microscopic photograph (magnification 100) showing the microstructure of a comparative material.

FIGS. 4*a* and 4*b* show microscopic photographs (magnification 100) of the microstructures of the material No. 5 of the invention and the comparative material No. 2.

From these Figures, it will be understood that, while the material No. 2 exhibit a multiplicity of elongated continuous eutectic carbides, the material No. 5 in accordance with the invention exhibits only few eutectic carbides which are short and discontinuous. Secondary carbides appear around the eutectic carbides in both microstructure.

Figure 5:
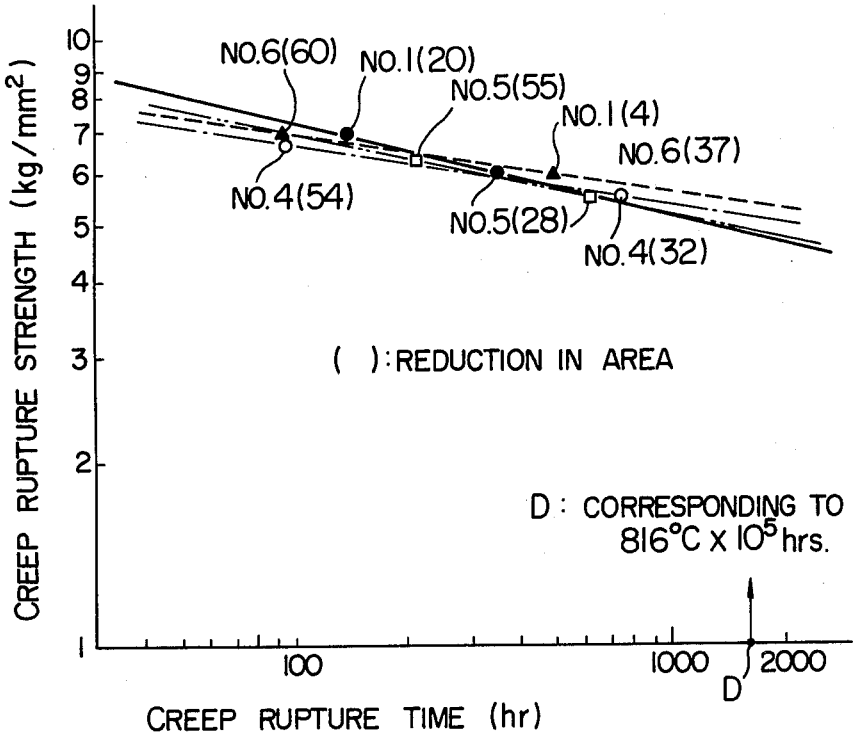
FIG. 5 is a graph showing creep rupture strength of various gas turbine nozzle materials.

FIG. 5 is a diagram showing the result of a creep rupture test conducted at 900° C. The test pieces had a diameter of 6 mm and a length of 30 mm as measured at straight portions thereof. In this Figure, the numerical value appearing in ( ) represents the creep rupture reduction of area (%). The alloy of the invention exhibits a mechanical strength which is somewhat smaller than that of the conventional alloy No. 1 in the region or large stress and short time. However, the alloy of the invention suffers only a small heat embrittlement and exhibits a higher creep rupture strength than the conventional material No. 1 in the region of small stress and long time. It is to be noted also that the alloy of the invention showed much greater creep rupture reduction of area than the conventional alloy No. 1. This means that the alloy of the invention has a high ductility and, hence, usable for a long time under application of heat well resisting to the thermal fatigue.

Figure 6:
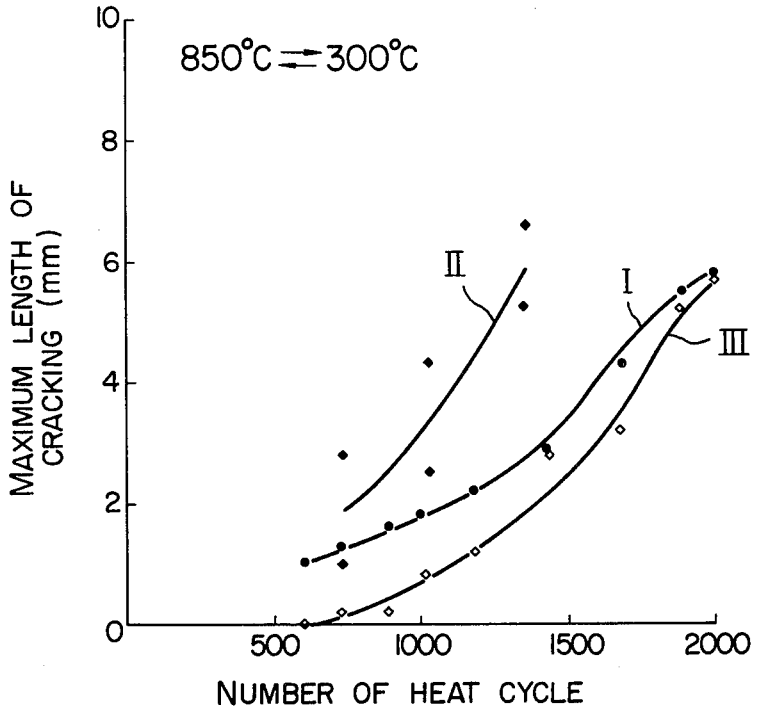
FIG. 6 is a graph showing how the thermal fatigue resistance is improved by a second aging treatment in the material in accordance with the invention.
Figure 7:
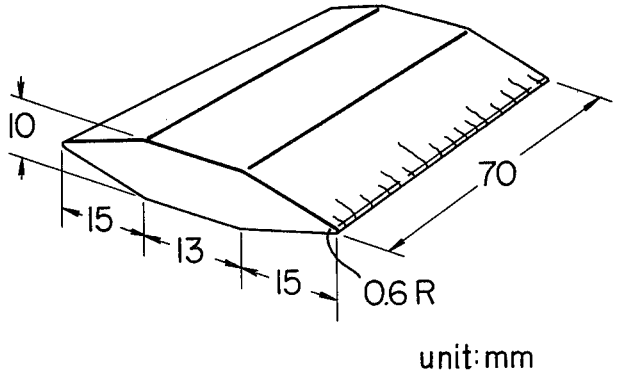
FIG. 7 is a perspective view of a test piece used in a fluidized bath test conducted for obtaining the graph shown in FIG. 6.

FIG. 6 shows the result of a fluidized bath test conducted with test pieces as shown in FIG. 7. In this test, each test piece was subjected to a repetitional heat cycles each consisting of heating to 850° C. and rapidly cooling to 300° C. In this Figure, a curve I shows the characteristics as observed with a material having the same composition as the material No. 1 in the Table and subjected to a solution heat treatment at 1150° C. for 2 hours followed by an aging treatment at 982° C. for 4 hours. Curves II and III show the characteristics as observed with test pieces of the composition in accordance with the invention consisting essentially of 0.24 wt % C, 27.9 wt % Cr, 21.7 wt % Co, 7.4 wt % W, 0.17 wt % Ti, 0.15 wt % Nb, 0.012 wt % B, 0.44 wt % Si, 0.50 wt % Mn and the balance Ni. The test pieces exhibited the characteristics of the curve II was subjected to a solution heat treatment at 1150° C. for 2 hours followed by a first aging treatment conducted at 982° C. for 4 hours, while the test piece exhibited the characteristics shown by curve III was subjected to a solid solution treatment at 1150° C. for 2 hours, a first aging treatment at 982° C. for 4 hours and then a second aging treatment conducted at 750° C. for 24 hours.

From the test result shown in FIG. 6, it will be understood that a remarkable improvement in the thermal fatigue resistance is achieved in the material of the invention when the same is subjected to the second aging treatment.

The alloy in accordance with the invention affords a remarkable improvement in the thermal fatigue resistance in the gas turbine nozzle which is formed by a precision casting in one body to have a plurality of blades which are fixed at their both ends.

As has been described, a gas turbine nozzle having superior thermal fatigue resistance and usable for long time is provided by the present invention.

What is claimed is:

1. A gas turbine nozzle made of a cast alloy consisting essentially of 0.1 to 1 wt % carbon, 0.1 to 2 wt % silicon, 0.1 to 2 wt % manganese, 20 to 35 wt % chromium, 0.001 to 0.1 wt % boron, 5 to 15 wt % of at least one of tungsten and molybdenum, 16 to 35 wt % cobalt and the balance nickel, said alloy having a heat-treated structure in which eutectic carbides and secondary carbides are dispersed in the matrix; said nozzle having been subjected, subsequently to a solution heat treatment, to a first aging treatment conducted at a temperature higher than the temperature at which said nozzle is used and then to a second aging treatment conducted at a lower temperature near the temperature at which said nozzle is used.

2. A gas turbine nozzle as claimed in claim 1, wherein the carbon and chromium contents are 0.15 to 0.4 wt % and 25 to 35 wt %, respectively.

3. A gas turbine nozzle made of a cast alloy consisting essentially of 0.2 to 1 wt % carbon, 0.1 to 2 wt % silicon, 0.1 to 2 wt % manganese, 20 to 35 wt % chromium, 0.001 to 0.1 wt % boron, 5 to 15 wt % of at least one of tungsten and molybdenum, 16 to 35 wt % cobalt, 0.02 to 2 wt % of a carbide former for forming MC type carbides and the balance nickel, said alloy having a heat-treated structure in which eutectic carbides and secondary carbides are dispersed in the matrix; said nozzle having been subjected, subsequently to a solution heat treatment, to a first aging treatment conducted at a temperature higher than the temperature at which said nozzle is used and then to a second aging treatment conducted at a lower temperature near the temperature at which said nozzle is used.

4. A gas turbine nozzle as claimed in claim 3, wherein said carbide former for forming Mc type carbides is at least one of tantalum, hafnium and zirconium.

5. A gas turbine nozzle as claimed in claim 3 or 4, wherein said carbides former for forming MC type carbide is at least one of 0.02 to 1 wt % titanium and/or niobium.

6. A gas turbine nozzle as claimed in any one of claims 3 and 4, wherein the atomic ratio M/C between the carbide former content and the carbon content falls within the range between 0.1 and 0.15.

7. A gas turbine nozzle made of a cast alloy consisting essentially of 0.2 to 1 wt % carbon, 0.1 to 2 wt % silicon, 0.1 to 2 wt % manganese, 20 to 35 wt % chromium, 0.001 to 0.1 wt % boron, 5 to 15 wt % of at least one of tungsten and molybdenum, 16 to 35 wt % cobalt, 0.05 to 2 wt % of at least one of yttrium and aluminum and the balance nickel, said alloy having a heat-treated structure in which eutectic carbides and secondary carbides are dispersed in the matrix; said nozzle having been subjected, subsequently to a solution heat treatment, to a first aging treatment conducted at a temperature higher than the temperature at which said nozzle is used and then to a second aging treatment conducted at a lower temperature near the temperature at which said nozzle is used.

8. A gas turbine nozzle made of a cast alloy consisting essentially of 0.2 to 1 wt % carbon, 0.1 to 2 wt % silicon, 0.1 to 2 wt % manganese, 20 to 35 wt % chromium, 0.001 to 0.1 wt % boron, 5 to 15 wt % of at least one of tungsten and molybdenum, 16 to 35 wt % cobalt, 0.1 to 2 wt % of carbide former for forming MC type carbides, 0.01 to 1 wt % of at least one of yttrium and aluminum and the balance nickel, said alloy having a heat-treated structure in which eutectic carbides and secondary carbides are dispersed in the matrix; said nozzle having been subjected, subsequently to a solution heat treatment, to a first aging treatment conducted at a temperature higher than the temperature at which said nozzle is used and then to a second aging treatment conducted at a lower temperature near the temperature at which said nozzle is used.

9. A gas turbine nozzle made of a cast alloy consisting essentially of 0.15 to 0.4 wt % carbon, 0.5 to 1.2 wt % silicon, 0.3 to 1 wt % manganese, 25 to 30 wt % chromium, 0.005 to 0.02 wt % boron, 6 to 9 wt % tungsten, 0.1 to 0.3 wt % titanium, 0.2 to 0.5 wt % niobuim, 16 to 35 wt % cobalt and the balance nickel, said alloy having a heat-treated structure in which eutectic carbides and secondary carbides are dispersed in the matrix; said nozzle having been subjected, subsequently to a solution heat treatment, to a first aging treatment conducted at a temperature higher than the temperature at which said nozzle is used and then to a second aging treatment conducted at a lower temperature near the temperature at which said nozzle is used.

10. A gas turbine nozzle as claimed in claim 9, wherein said cast alloy further contains 0.05 to 0.3 wt % yttrium.

11. A gas turbine nozzle as claimed in any one of claims 1, 3, 7, 8 and 9, wherein said solution heat treatment is conducted at a temperture between 1100° and 1200° C. while said first aging treatment is conducted at a temperature between 950° to 1050° C.

12. A gas turbine nozzle according to claim 11, wherein said second aging treatment is conducted at a temperature between 700° and 800° C.

13. A gas turbine nozzle as claimed in any one of claims 1, 3, 7, 8 and 9, wherein the Co content of said alloy is from 20 to 30 wt %.

14. A gas turbine nozzle as claimed in claim 12, wherein the Co content of said alloy is from 20 to 30 wt %.

* * * * *